United States Patent [19]

Nolan

[11] 4,201,035

[45] May 6, 1980

[54] WINDING MACHINE

[75] Inventor: John P. S. Nolan, Northwood, England

[73] Assignee: John Nolan Design Limited, London, England

[21] Appl. No.: 931,733

[22] Filed: Aug. 7, 1978

[30] Foreign Application Priority Data

Aug. 11, 1977 [GB] United Kingdom ..... 21642/76

[51] Int. Cl.[2] ..... D07B 7/06; B21F 3/04

[52] U.S. Cl. ..... 57/6; 57/9; 57/58.38; 57/138

[58] Field of Search ..... 57/3, 6, 9, 18, 33, 57/58.36, 58.38, 58.83, 59, 138, 156, 166; 72/66, 127, 135, 146, 149; 140/71 C, 92.1, 124, 149

[56] References Cited

U.S. PATENT DOCUMENTS

| | | | |
|---|---|---|---|
| 1,788,641 | 1/1931 | Sunderland | 57/138 X |
| 3,342,026 | 9/1967 | Nichols et al. | 57/138 X |
| 3,499,276 | 3/1970 | Schmid et al. | 57/34 HS |
| 3,572,023 | 3/1971 | Galonska | 57/34 HS X |
| 3,641,755 | 2/1972 | Heinen | 57/138 X |
| 3,680,604 | 8/1972 | Frohlich et al. | 57/138 X |
| 3,732,679 | 5/1973 | Sohr | 57/34 HS |
| 3,896,860 | 7/1975 | Ianucci | 140/149 |
| 3,984,970 | 10/1976 | Terada et al. | 57/156 X |
| 4,073,127 | 2/1978 | Orlandi et al. | 57/58.36 |

FOREIGN PATENT DOCUMENTS

| | | | |
|---|---|---|---|
| 656008 | 1/1935 | Fed. Rep. of Germany | 57/9 |
| 314843 | 7/1929 | United Kingdom . | |
| 1011699 | 12/1965 | United Kingdom . | |
| 1344506 | 1/1974 | United Kingdom . | |

*Primary Examiner*—Donald Watkins

*Attorney, Agent, or Firm*—Diller, Ramik & Wight

[57] ABSTRACT

A machine for winding a filament, such as wire, on a normally stationary mandrel, the machine having a single winding element provided with guides for forming a filament loop on one side only of a rotational axis. Non-rotating feeding means supplies the filament to the rotating loop and means are provided for removing the turns from the mandrel. A binding or positioning element is fed from a supply located outside the zone of rotation of the winding element, the binding or positioning element being fed down inside the filament coils to secure them for removal from the mandrel. The binding or positioning element may be a wire or a solid rod supported by an extension of the mandrel which projects towards the filament feed. The mandrel extension may be an enlongated tube mounted in bearings in one or more fixed supports between the winding element and the filament feed. Different means are disclosed for restraining rotation of the mandrel, including gear wheels, bevelled gears, magnetic pole pieces and rotatable detents.

20 Claims, 11 Drawing Figures

WINDING MACHINE

CROSS-REFERENCES TO RELATED APPLICATIONS

My British Patent Application No. 21642/76 was accompanied by a Provisional Specification filed on May 25, 1976 and by a Complete Specification filed on Aug. 11, 1977. The Complete Specification contains subject matter additional to the Provisional Specification and this application is partly based on that additional subject matter and on further subject matter.

FIELD OF INVENTION

This invention relates to a winding machine useful for making for example, heat transmission devices having a surface or surfaces (tubular, plane or otherwise) to which is attached a "ribbon" of wire, the wire in the "ribbon" being wound helically, for example, in a flat helix. The term "ribbon" is used to denote a run or length of coiled wire, for example, an energy transmission device may be formed by winding the wire in a first helix of a predetermined cross-section to form the ribbon, the ribbon being wound in a second helix on a copper tube. That part of the process which forms the ribbon of helically wound wire is hereinafter called "winding". Winding is effected by a "winding machine" wherein a length of supply wire is formed into a loop which is caused to rotate about a mandrel. Such a rotating loop is effected by a "winding element" having one or more guides which extend radially of the axis of rotation (normally the axis of the mandrel). The winding process may be illustrated by considering a skipping rope where rope is fed in at one end of the rotating loop and removed from the other end after being coiled about a fixed rotational axis. In a machine according to the invention, a binding or positioning element is also supplied down the inside of the filament turns to secure them when removed from the mandrel on which they were formed.

In view of the problems pertaining to a winding machine, particularly one which is operating at high speed, it is desirable to simplify construction as far as possible. However, this problem faces certain difficulties in view of the following requirements.

(a) Rapid and snag-free wire feed from a supply spool to a winding element which is rotating at high speed about a mandrel which is usually of a circular cross-section.

(b) Removal of the ribbon of wound turns from the mandrel and subsequent handling including feeding the ribbon to a surface of a body to which it is to be attached and binding the ribbon to the body.

(c) Supplying a binding or positioning element, such as a wire or rod, inside the ribbon to secure the ribbon to the body mentioned in (b) above.

(d) Accessibility and accommodation of the binding or positioning element.

PRIOR ART AND BACKGROUND TO INVENTION

U.K. Patent Specification No. 314,843 describes a winding machine of considerable complexity in which wire is fed in respective loops on opposite sides of the axis of rotation in order to accommodate rotating and non-rotating parts of the machine. U.K. Patent Specification No. 1,011,699 describes a winding machine which is less complex but which employs a rotating wire feeding means. Moreover, it does not make provision for supplying a binding or positioning element down the inside of the coils of the filament wound on, and subsequently removed from a mandrel. U.K. Patent Specification No. 1,344,506 describes a winding machine having a rotating wire feed and which employs an assymetric mandrel to provide gravitational restraining means to prevent mandrel rotation.

The Provisional Specification of my British Patent Application No. 21642/76 describes non-rotating means to feed a wire filament to a single winding element. Such non-rotating means reduce even further the complexity of a winding machine.

The present invention seeks to improve the design of a winding machine still further, especially with regard to the requirements of (c) and (d) above.

SUMMARY OF INVENTION

In a winding machine according to the present invention, a single winding element with one or more guides is used to entrain a filament, supplied from feeding means, in a radial loop which extends on one side only of the rotational axis of the winding element. The winding element is of integral or unitary form so that its position, relative to the filament feeding means, may be selected in accordance with design requirements having regard to the supply of a binding or positioning element longitudinally of the rotational axis and usually down the inside of the coils which are wound on the mandrel. The binding or positioning element supply is positioned on an extension of the mandrel outside the zone of rotation of the winding element. Besides the advantage of greater accessibility of the binding or positioning element, the winding element can be made of a more compact design. For example, its bearings may be of a smaller diameter compared with certain prior art constructions because a binding or positioning element supply is not positioned within the zone of rotation of the winding element. Usually, restraining means are employed to prevent rotation of the mandrel but, in special cases, the mandrel may be caused to rotate in a controlled fashion. Such restraining means may comprise gear means, magnetic means or synchronous engagement means to prevent rotation of the mandrel.

The term "filament" is used herein to include wire or similar material which may be fed from a supply means such as a reel or container. Preferably, the filament is fed by non-rotating feeding means, such as a fixed guide, to the single winding element. For example, the filament may be fed through a fixed, sleeve-shaped guide having, preferably, a conical or flared outlet end to facilitate passage of the filament as the loop rotates about the rotational axis. A non-rotating feeding means simplifies machine design.

The single winding element includes filament guides such as wheels mounted on pivots, or slides, which are not caused to rotate by passage of the filament. Preferably, the filament is entrained in a substantially straight line between the first guide or slide on the winding element and the filament feeding means. This eliminates the need for intermediate rotating and supporting structures and reduces associated stresses due to rotation.

The positioning or binding element may be a wire supplied from a reel mounted on a hollow mandrel extension, or it may be a more rigid element, such as a rod, fed through an elongate and hollow mandrel extension. In the case of a long rod, the extension is suitably supported in bearings in one or more fixed members which are located between the single winding element and the filament feed. However, the mandrel extension may be supported as a rigid cantilever (extending from the mandrel proper), the only requirement being sufficient rigidity in the extension to prevent undesirable flexing during feeding of the positioning or binding element.

The filament coils wound on the mandrel may be removed by known means such as those disclosed in, for example, U.K. Pat. Nos. 282,244, 314,843, 1,011,699 or 1,344,506.

DESCRIPTION OF DRAWINGS

FIG. 1 is an elevation, mainly in section, showing the winding element of a winding machine.

FIG. 2 is an elevation, mainly in section, and omitting some of the detail of FIG. 1, showing the layout of wire supply means and a guide forming part of a single winding element according to another arrangement.

FIG. 3 is an elevation, partly in section, of a single winding element of an embodiment of the present invention, wherein the zone of rotation of the winding element is spaced from a supply reel for binding wire.

FIG. 4 is an elevation, partly in section, of a single winding element according to a further embodiment of the invention, wherein a positioning rod is fed to a mandrel for positioning the turns of coiled wire.

FIG. 5 is a sectional view of part of a winding machine and the Figure schematically illustrates an alternative position for restraining means described with reference to FIG. 9 or 10.

FIG. 6 is an elevation, mainly in section, of part of a winding machine similar to the embodiment of FIG. 3 and showing a geared arrangement for restraining rotation of the mandrel.

FIG. 7 is a bevelled gear arrangement, equivalent in effect to the arrangement shown in FIG. 6, but applied to the embodiment of FIG. 4.

FIG. 8 illustrates, mainly in section, part of a winding machine and the Figure shows a possible position for restraining means described with reference to FIG. 9 or 10.

FIG. 9 is an elevation, mainly in section, looking along the direction of the arrows AA of FIG. 5 of part of a winding machine to show electromagnetic means for restraining rotation of the mandrel.

FIG. 10 is an elevation, mainly in section, of part of a winding machine according to another embodiment which employs rotatable detent means for restraining rotation of the mandrel.

Referring to FIG. 1, a winding machine includes a fixed frame 1 to which a detachable plate 3 is fastened. A winding element, generally indicated by reference 5, is mounted for rotation in bearings 7,9 about a winding axis 11. Reel carrying means 13, restrained from rotating relative to frame 1 by means to be described, is carried in the hollow winding element 5 by bearings 15 and 17. Preferably, bearings 7, 9, 15 and 17 are coaxial. The winding element 5 is rotated by a toothed belt 19 driven by known means (not shown) as will be apparent to one skilled in the art, the belt driving a toothed pulley 21 attached to element 5. Means 13 carries a mandrel 23 on which windings are formed of a filament or wire 25. Wire 25 enters a non-rotatable supply guide 27, in the form of an element with a convex surface, at the rear of the machine. The wire 25, approaching guide 27, need not necessarily be on the axis 11. It passes over guides 29 and 31 to the mandrel 23. In some designs, (see below) guide 29 may be dispensed with. Depending on the overall design, any or all of guides 27, 29 and 31 may be rotatably mounted on pivots. In the present case, only guide 31 is pivotally mounted.

Figure 1:
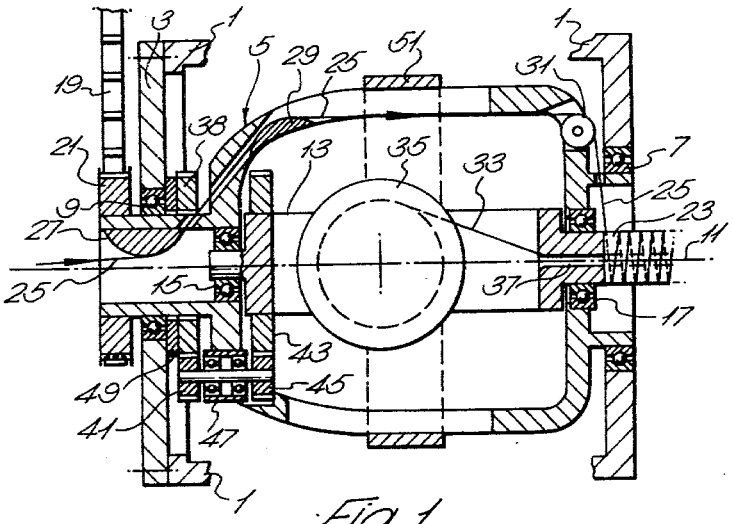
FIGS. 1 and 2 illustrate embodiments described in the Provisional Specification of my British Patent Application No. 21642/76 and have been included herein to illustrate the development of the present invention.

A binding wire 33 is stored on a spool or reel 35 mounted on means 13. Wire 33 is tensioned by known tensioning and tension monitoring devices (not shown, but see for example, UK Pat. Nos. 314,843 and 1,011,699) and is fed through a duct 37 on the axis 11 and then down inside the windings of wire 25 as the latter windings are fed off the mandrel 23. The windings are fed off mandrel 23 by known means (not shown) such as an inclined member which abuts the first turn of the winding on the mandrel and thereby serves to urge the windings from the mandrel as they are coiled one after the other along the axis 11. Known means (not shown but see for example UK Pat. No. 3148,43) may be provided for monitoring the amount of wire 33 on spool 35. The binding wire may comprise bonding agents such as solder, which could be carried in filament form on separate spools, or be bonded to the binding wire 33. The purpose of wire 33 and the bonding agent will be described later.

Mandrel restraining means comprises a gear pair 38, 41 and a gear pair 43, 45 and a shaft 47 mounted in a bearing assembly in winding element 5. The ratio of gear 41 to 38 is the same as the ratio of gear 45 to 43 so that the mandrel 23 (and therefore the reel supporting means 13) is restrained from rotating relative to frame 1. Gear 38 is attached to plate 3 via a spacer 49.

When the machine is in operation, wire 25, by the action of being wound on mandrel 23, is drawn through the winding element 5 from a suitable supply (not shown) via known tensioning devices (not shown). It will be noticed that whilst shaft 47 bridges the gap through which wire 25 passes, the wire 25 and shaft 47 rotate about axis 11 at the same angular velocity and so do not hinder one another.

A number of other restraining means are possible which may be conveniently defined as flexible and inflexible. Inflexible types include various mechanical arrangements of gears, one of which is shown here, and other meshing elements which allow negligible angular movement of means 13 and mandrel 23 relative to frame 1. However, in some designs, a significant angular movement of means 13 and mandrel 23 is permissible, provided continuous rotation does not occur, and in these cases flexible restraining means can be employed. The restraining means, in any case, may possess resilience in torsion to reduce overloading where present and may include electromagnetic, magnetic, pneumatic, gyroscopic or gravitational systems. With some flexible systems, it may be necessary to include rotation monitoring devices and cut-outs to detect and prevent excessive angular movement. Winding element 5 is designed so that the machine can be recharged with wire 33 in a suitable manner. In the present case, element 5 is cut away to allow removal of spool 35. A ring 51 may be required on element 5 to reduce the stresses resulting from rotation about axis 11. This ring, whilst retaining its position during operation of the machine, can be removed or displaced so that spool 35 can be changed. The restraining means and drive belt 19 and pulley 21 are placed at the rear of the machine to leave the front uncluttered and to improve accessibility to mandrel 23.

In the following description, not all elements will be described which have the same reference number as those mentioned above.

Figure 2:
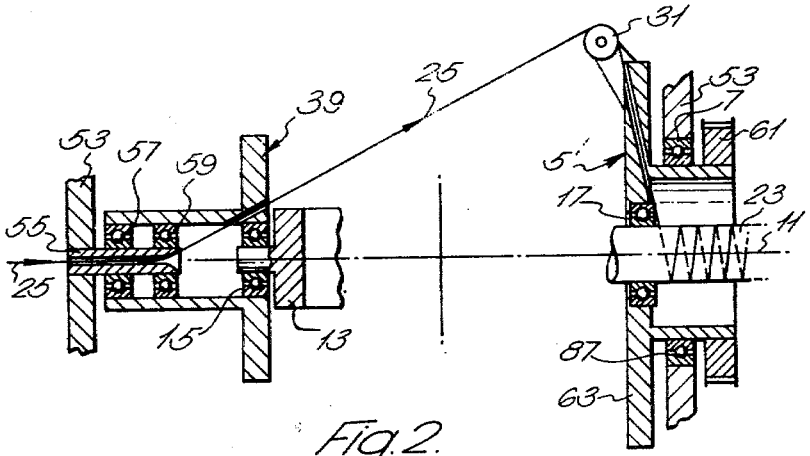

In FIG. 2, a number of changes have been made to simplify or otherwise improve the design. In particular, a fixed frame 53 replaces the detachable plate 3 in FIG. 1, slide 55 fixed to frame 53 replaces slide 27 of FIG. 1. By moving the wire feeding guide 55 away from the mandrel, and/or moving guide 31 radially from axis 11, the wire 25 can be taken directly from guide 55 to the pivoted guide 31. The guide 31 is mounted on the single winding means 5'. The reel supporting means 13 is supported at the rear, in bearings 15, carried by the supporting element 39 having an apertured circular flange-shaped portion. It is to be noted that the wire 25 does not touch the interior surface of the aperture through the flange of supporting element 39. The aperture is present merely to allow the passage of the wire 25 therethrough as element 39 rotates synchronously with part 5'. The other end of the mandrel is supported in a bearing 17 in a flange-shaped part 5'. Parts 5' and 39 need not have circular flanges as shown. They can also have counterbalanced arms to serve the same purpose.

Pulley 21 of FIG. 1 is replaced by a pulley 61 driven by a toothed belt (not shown). Part 5' and element 39 are driven at the same average speed, by suitable connection, and in a manner to allow unrestricted passage of wire 25 onto mandrel 23. For example, pulley 61 and a pulley (not shown) mounted on part 39 may be driven by means suitably geared together. Alternatively, parts 5' and 39 can be connected by wires made of Nylon (Registered Trade Mark), high tensile steel or other suitable material. Regarding the stresses set up due to rotation, the almost purely tensile stresses in these light flexible elements can be made much lower than those stresses in the winding element which result from bending. Part 39 is provided with a flange 63 to give a more suitable point of attachment at a greater radius. To facilitate further the design changes, the spool supporting means 13 is restrained from rotation by gravitational means (not shown). The gravitational means is not illustrated, to simplify the drawing, but it can be briefly described as follows.

Means 13 is loaded eccentrically relative to the axis of bearings 15, 17. When the machine is in operation, the mean torque resulting from winding the wire 25 onto the mandrel 23 displaces means 13 by an angular amount sufficient for the eccentric load to exert an equal and opposite restoring torque. The design should be such that the angular displacement of means 13 to this equilibrium position is within acceptable limits.

In a further modification of the design of FIG. 2, the axis 11 is vertical whereby part 39, its supporting structure and driving means can be dispensed with. A geared or other suitable restraining means will then have to be incorporated in element 5' and bearing arrangements suitably redesigned, depending upon whether the rear end or front end is uppermost.

Figure 3:
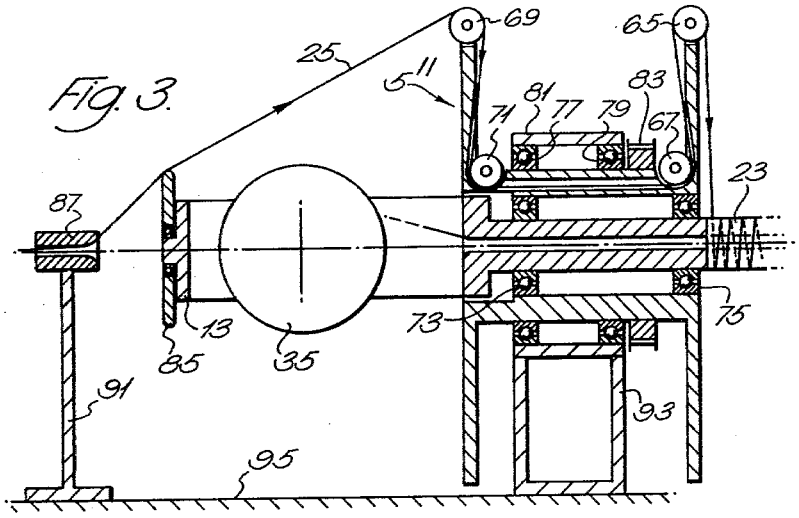
FIGS. 3–10, described below, illustrate embodiments of the present invention.

FIG. 3 shows an embodiment of the invention in which there is a further improvement in design, in particular, with regard to the bearing layout and accessibility of the mandrel 23. The single winding element 5" has a spool shaped body which carries a pair of front guides 65 and 67 and a pair of rear guides 69 and 71. The spool 35 is supported by means 13 in cantilevered fashion in a modified bearing arrangement 73, 75. Thus, the supporting frame 1 can be eliminated together with associated bearings. Bearings 77 and 79 replace bearing 7 (FIG. 2) and are carried in a housing 81 supported on an element 93 which replaces frame 1 (FIG. 2). Bearings 73 and 75 replace bearing 17 (FIG. 2). A driving pulley 83 driven by a toothed belt (not shown) is attached to winding element 5". Means 13 may carry at its rear end a slide or pivoted guide 85 which serves a similar function to that of slide 29 in the embodiment of FIG. 1. Guide 85, whilst keeping wire 25 clear of means 13 and 35, enables the feeding means, comprising guide 87, to be brought forward so reducing the axial length of the winding machine. Guide 87 is fixed in support 91 and supports 91 and 93 are mounted on a base plate 95. Any suitable restraining means, either described herein, or otherwise known, may be used in this embodiment.

The machine so far described may be used, in particular, for the manufacture of heat transfer elements, in such methods of manufacture, additional means are used for winding the binding wire 33 in a suitable configuration onto a surface, herein called a receiving surface. Such a method of removing turns of wire from a mandrel and of securing the wire turns as a ribbon on a receiving surface with a binding wire is known from U.K. Patent Specification No. 282,244. The windings of wire 25 become trapped between the receiving surface and the binding wire, which is tensioned by known methods as necessary and as taught, for example, in U.K. Patent Specification No. 314,843. At a later stage, bonding takes place using known techniques. The receiving surface is preferably convex in shape and includes the hollow tubes and solid rods used in known manufactures. In order to secure wire turns, in the form of a ribbon for a heat exchanger, a solid rod can be used as the binding or positioning element. In this case, the end of the first turn of the wire removed from a hollow mandrel is attached for example, by soldering, to the solid rod which is supplied, as the binding or positioning element. The wire turns are removed by known means (as taught for example, in U.K. Patent Specification Nos. 282,244; 314,843; or 1,011,699) or by the means described later with reference to FIG. 11, and the solid rod is simultaneously fed down the inside of, and withdrawn from the hollow mandrel whilst the rod is rotated and the turns of wire are positioned, by friction, on the rod to provide a required helical pitch for the ribbon of coiled wire. The mandrel could also be rotated, in a controlled fashion, relative to rod 97, to provide the required helical pitch for the ribbon. Preferably, the relative dimensions of rod 97 and coils of wire 25 are such that the coils are held in correct position relative to rod 97 by friction. This is particularly important if the helical pitch of the ribbon is so long that the coils of wire 25 could become unacceptably displaced relative to rod 97. At a suitable stage, the coils of wire 25 will be bonded to rod 97. When a sufficient length or the end of the rod has been reached, the wire which is wound on the mandrel is cut and the end turn of the ribbon is attached to the rod, for example, by a bonding agent such as solder. The bonding agent may be supplied in the way already mentioned or in other suitable ways. Rod 97 may be of circular or acircular cross section. Whilst an acircular cross section may assist in the bonding process and the holding of the coils at the correct helical pitch, it has the disadvantage that it must be supplied to the machine pretwisted at the correct helical pitch, or twisting means must be provided within the machine.

Figure 4:
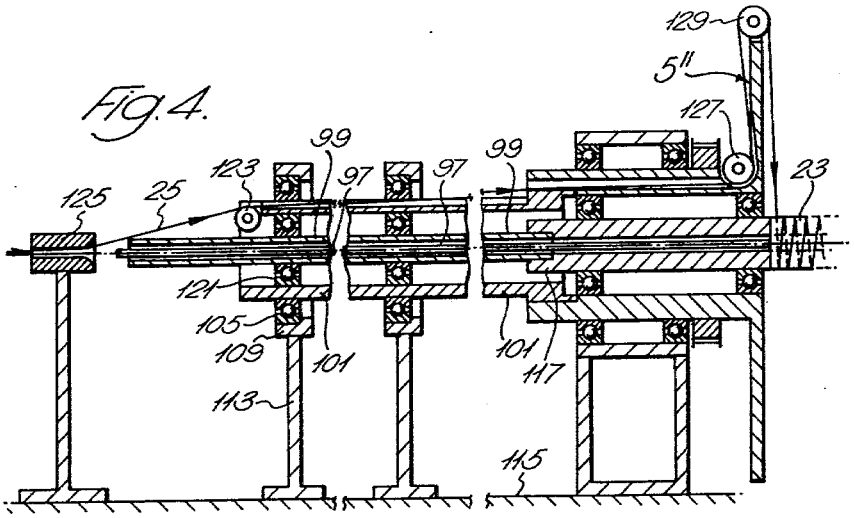

Referring to the embodiment of FIG. 4, changes in design have been made to facilitate the above method of manufacturing a wire ribbon for a heat exchanger wherein the binding or positioning element may be in a more rigid form, for example, a rod 97 which is solid or tubular, the rod being fed by tubular means 99 (which replaces spool 35 of the previous embodiments). Further changes in design are as follows. The flange to the rear of the winding element 5'' (FIG. 3) has been replaced by an axial extension 101 which is carried at suitable intervals in bearings 103, 105 etc., which are mounted in housing 107, 109 and fixed via supports 111, 113 etc., to base plate 115. Carrying means 117 carries means 99 as a non-rotating extension and means 99 is carried, where necessary, by bearings 119, 121 mounted in extension 101. Bearings 119 and 121 need not be placed close to 111, 113 as shown. If rod 97 is in sufficiently short lengths, it may not be necessary to support extension 101 and bearings 103, 105 and associated elements can be omitted. Even though, for similar reasons, means 99 may not need the support of extension 101 via bearings 119, 121, extension 101 will probably be required to carry a guide 123 which holds wire 25 clear of rod 97 and means 99. Where rod 97 is in sufficiently short lengths, the basic embodiment of FIG. 3 could be used. Only minor modifications would be required such as removal of reel 35 and associated parts so that rod 97 can be fed through duct 37. Both extension 101 and means 99 may have openings in them for inspection and other purposes such as joining new lengths of rod 97 to that already in the machine. Suitable monitoring devices can be fitted to detect when this joining process needs to be carried out, and if required, this could be done automatically, the wire 25 enters the winding head via feeding means comprising guide 125, passes over guide 123, which need not be pivoted, as shown here, provided friction can be kept sufficiently low, and then passes through bearings 119, 121 (when present). Extension 101 could be extended beyond the end of means 99 and include a guide similar to guide 27 in FIG. 1. In this case, guide 125 may be dispensed with. The machine can be extended over a great length, if required, and for these reasons extensions 101, wire 25, rod 97 and means 99 are shown broken. However, resilient means, using known techniques, may be required to reduce the length of wire 25 subject to speed variations due to winding on a mandrel of acircular cross-section. Such means could include the resilient mounting of guides 127 or 129. In order to increase the versatility of the winding machine, couplings may be introduced between means 99 and 117 and 101 and 5'', which couplings are preferably easily detachable and flexible to allow acceptable misalignment whilst reducing bearing loadings and other stresses which might result from such misalignment.

To prevent continuous rotation of the mandrel 23, and extensions 117 and 99, restraining means of suitable design must be used. Such designs may include known means and those described herein.

Figure 5:
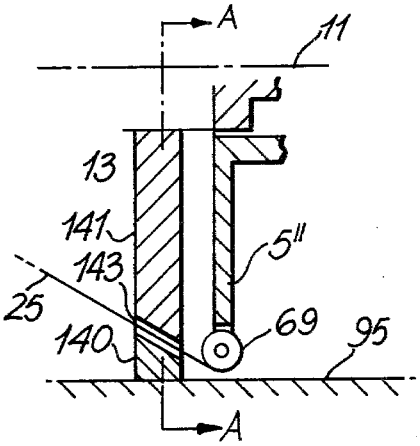

FIG. 5 shows a broken away view of part of the embodiment of FIG. 3 and it shows the position of a gap through which the wire 25 can pass unhindered and across which restraining means of a suitable design can act. As shown in FIG. 5, the winding element 5'' has been rotated so that guide 69 is in a bottom position. A member 140 is fixed to base plate 95 and a member 141 is fixed to mandrel 23 or its extension 13 such that there is an arcuate gap 143 between members 140 and 141 through which the filament 25 can pass unhindered. The circular edges of members 140 and 141 are chamfered so that the gap 143 is inclined, circumferentially, to accommodate the cone of rotation of filament 25.

Figure 6:
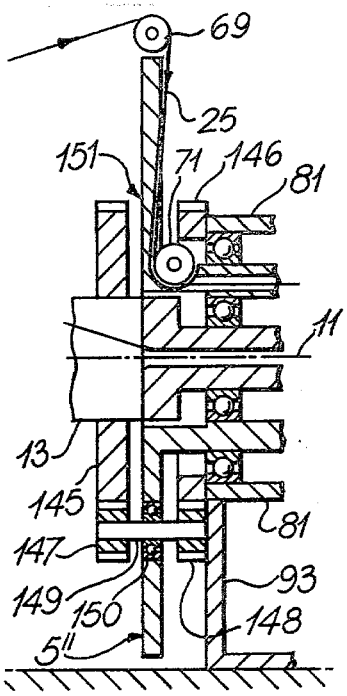

FIG. 6 shows a broken away view of part of the embodiment of FIG. 3 and illustrates geared restraining means for the mandrel 23. Such restraining means comprises a gear 145 which is fast with the mandrel extension 13, a gear 146 which is fast with housing 81, a gear 147 which meshes with gear 145, and a gear 148 which meshes with gear 146. Gears 147 and 148 are mounted for common rotation on a shaft 149 which is mounted rotatably in bearing 150 in the winding element 5''. The basic principles of operation are the same as those for the embodiment of FIG. 1. The ratio of gear 145 to 147 is the same as the ratio of gear 146 to 148 so that, whatever speed gears 147 and 148 rotate about the periphery of gears 145 and 146, due to rotation of winding element 5'', gears 145 and 146 remain stationary relative to one another. The filament 25 running between the guides 69 and 71, not shown in FIG. 6, passes unhindered through a gap 151 between gear 145 and gear 146. This is because the axes of guides 69, 71 and of shaft 149 are all fixed in the winding element 5''.

Figure 7:
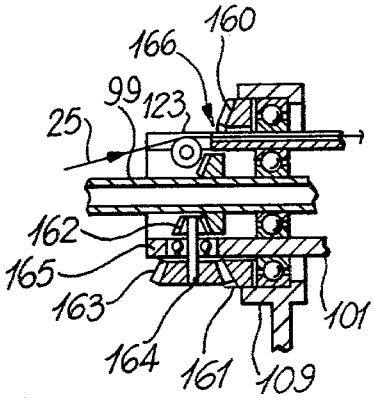

FIG. 7 shows a broken away view of part of the embodiment of FIG. 4 without the rod 97 but with an additional modification. This modification includes geared restraining means which employs bevel gears. The basic principles of operation are the same as those for the embodiments of FIGS. 1 and 6. A bevel gear 160 is fast with the non-rotating extension 99 of the mandrel 23. A bevel gear 161 is fast with housing 109. A bevel gear 162 meshes with gear 160 and a bevel gear 163 meshes with gear 161. Gears 162 and 163 are mounted for common rotation on a shaft 164 which is mounted rotatably in bearings 165 in the axial extension 101. As the filament 25 is taken on to the guide 123 mounted on extension 101, it is free to pass unhindered through a gap 166 between gears 160 and 162.

Figure 8:
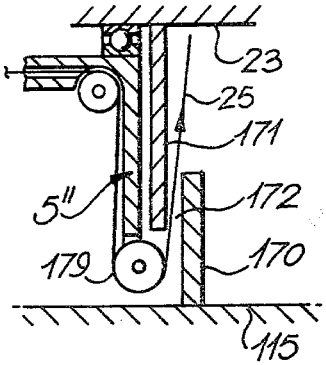

FIG. 8 shows a broken away view of part of the embodiment of FIG. 4 with a further modification. The winding element has been rotated so that the guide 179 is in a bottom position. A member 170 is fixed to base plate 115. An element 171 is fixed to mandrel 23 or its extension. There is a gap 172 between members 170 and 171 through which the filament 25 can pass unhindered.

Gravitational restraining means, wherein the mandrel is loaded eccentrically as taught in U.K. Pat. No. 1,344,506, or wherein the mandrel extension is similarly and eccentrically loaded, can be incorporated in member 141 of FIG. 5, and in member 171 of FIG. 8. The respective fixed members 140 and 170 are not necessarily required.

Magnetic restraining means may alternatively be employed, such means including electromagnets or permanent magnets, or both. For example, the fixed member 140 of FIG. 5 and the fixed member 170 of FIG. 8 can be, or include the pole pieces of an electromagnet or a permanent magnet. FIGS. 5 and 8 are schematic in that they show some suitable positions for the gap (143 or 172) between the pole pieces of a field winding or permanent magnet on one side and a ferromagnetic armature or electromagnetic pole pieces (141 or 171) on the other side. Incidentally, in the case of mechanical systems using meshing elements, members 140, (FIG. 5) and 170 (FIG. 8) can conveniently be the mounting for such meshing elements or detents which engage with respective elements (141 and 171 respectively).

Figure 9:
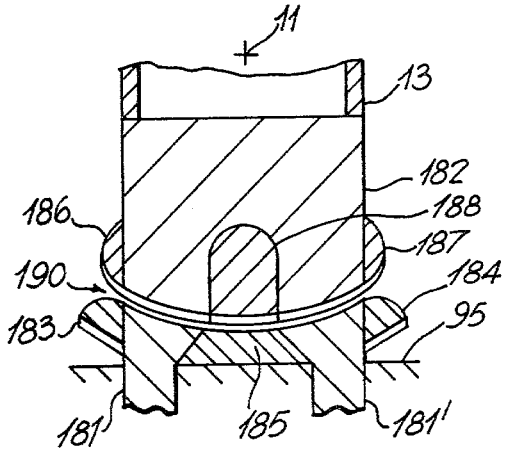

FIG. 9 is a schematic view, in cross-section, of an electromagnetic restraining means, the section shown in FIG. 9 approximating to the section AA of FIG. 5. Fixed legs or members 181 and 181' are a pair of pole pieces of opposite polarity and of ferromagnetic material. They are fixed relative to the base plate 95 and are equivalent to member 140 of FIG. 5. A member 182 is an armature of ferromagnetic material which is fixed to mandrel 23 or its extension 13. Elements 183, 184 and 185 are fillings of non-magnetic material of low magnetic permeability around members 181 and 181'. Elements 186, 187 and 188 are fillings around the armature 182 of similar material to that of elements 183, 184 and 185. The purpose of this filling material is to form a smooth surface in the gap to reduce the chance of filament 25 snagging, but with minimum interference with the effectiveness of the magnetic field. In order for the distance across a gap 190 to be as small as possible, the sides of the gap conform as closely as possible to the surface of revolution traced out by the filament 25. In this case, the sides of the gap are preferably parts of cones. In operation, the spool supporting means 13 and member 182 take up an angular displacement relative to members 181, 181' about the axis 11. This angular displacement increases until the restoring forces due to the distorted magnetic field equal the displacing forces due to the winding of filament 25 on the mandrel 23. If required, there can be a plurality of pairs of poles, with equivalent armatures. Only one embodiment is shown, by way of example. The system of FIG. 9 could also be applied to FIG. 8 wherein member 171 is in the position of the armature and member 170 is in the position of the pole pieces.

Figure 10:
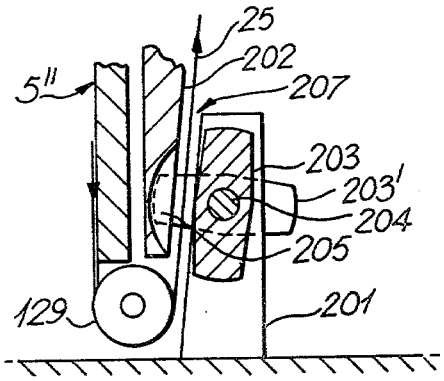

FIG. 10 schematically illustrates a mechanical meshing system equivalent to the view shown by FIG. 8 Member 201, equivalent to member 170 (FIG. 8), is a mounting fixed to the base plate 115 (FIG. 4). Member 202, equivalent to member 171 (FIG. 8), is fixed to mandrel 23 (not shown). The filament 25 passes from guide 129 through a gap 207 between members 201 and 202. Detent members 203 and 203' are at right angles to one another and are mounted on, and driven by a shaft 204, mounted rotatably in member 201. Each member 203, 203' is designed to mesh twice per revolution in respective grooves 205 in member 202 (only one of which is visible in FIG. 10). The shaft 204 is synchronised to rotate at half the speed of the winding element 5'' so that the filament 25 avoids collision with either one of the two detent members 203 or 203'. The means to achieve such synchronisation may include a gear train or toothed belt means (possibly used with a gear train) coupled between a gear on the shaft 204 and a gear on the winding element 5'' or rotational drive therefore. The arrangement of such means will be obvious to one skilled in the art. The general principle of operation underlying this embodiment is that a detent member must be withdrawn sufficiently to allow the passage of filament 25 as shown by the position of detent member 203 in FIG. 10, but at least one detent must be engaged at any one time as shown by the position of detent member 203' in FIG. 10. Unless some inertia effect is to be used, it is preferable to have at least two detents. In the system shown, in which there are two engagement cycles for each detent per rotation of the shaft 204, the two rotary detents will be phased preferably at 90° to one another and spaced to engage at positions preferably 90° apart in the rotation of the winding element.

The detent members may be of a design other than those shown in FIG. 10. For example, they may be in the form of circular discs each with a cut out position to enable passage of the wire 25 on synchronous rotation. Such discs would engage member 202 once in each cycle or revolution and would run at the same speed as the winding element. The cut out portions would be phased preferably at 180° to one another so that on rotation of the winding element by a suitable synchronous drive, they will be 180° apart on the cycle of the winding element. A disadvantage of the latter is their higher speed, but they can probably be made smaller in size for a given gap length and depth of engagement. Plunger type systems can also be used and operated by known means such as cams and cranks but the advantages of the rotary system described are that the system can be simpler and more easily dynamically balanced.

Another general principle governing the design of restraining means is that the gap should be positioned at maximum possible radius from the axis of rotation of the winding element. This reduces restraining forces to a minimum. In the geared case, this may be offset by the increased forces on the epicyclic gear set rotating at increased radius. However, in the magnetic case, the added advantage is that with gaps of increased radius, there is more room for increased area of air gap. In general, this can enable increased forces to be generated in the air gap for a given size or strength of magnet.

Figure 11:
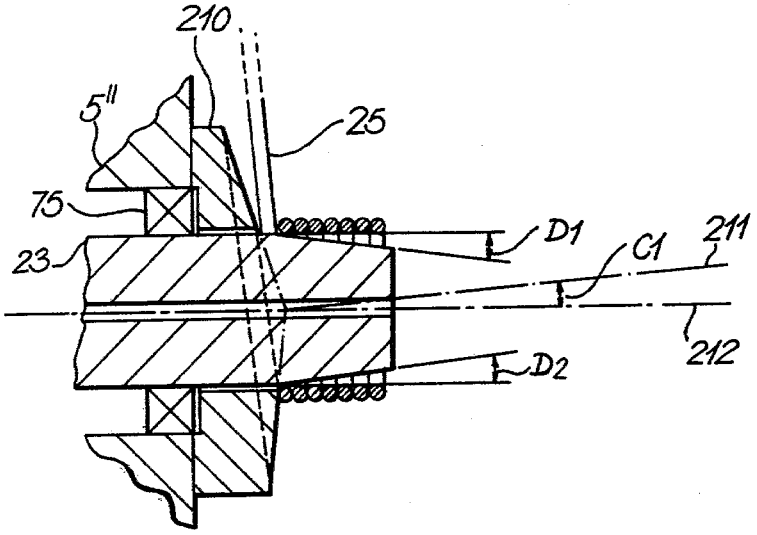
FIG. 11 is a scrap section illustrating means for removing turns of wire from the mandrel of, for example, the winding machine shown in FIG. 3.

With reference to FIG. 11, an embodiment is shown of a preferred means for feeding coils of wire 25 off the mandrel 23. The Figure shows a scrap section of the embodiments of FIG. 3 or 4 with the addition of a coil removing member 210 which is fixed to and rotates with the flange part of the winding element 5''. The action of member 210 (on each rotation) is to feed the coils of wire 25 along the mandrel 23 by an amount which is preferably at least one wire diameter. The winding element (5'') rotates relative to mandrel 23, the wire 25 is laid onto the mandrel and the new coil is formed in the space on the mandrel uncovered by member 210. The surface of 210 may be an inclined plane as taught in U.K. Pat. No. 282,244 but a preferred way of forming a suitably shaped surface on member 210 is to machine a cone whose axis of generation 211 is at some suitable angle $C_1$ to the axis of rotation 212 of the winding element (5''). In order to reduce any binding between the mandrel and the coils of wire 25 as they are fed, the end of the mandrel is tapered at suitable angles $D_1$ and $D_2$ which need not be equal. The mandrel could be tapered on one side only for example, but it is preferable to have taper on both sides as shown. The action of member 210 is similar to that of the inclined plane mentioned above but, in this case, the inclined plane is relieved by a conical surface whose axis intersects with, but is at an angle to the axis of rotation of the winding element so that there is less likelihood of contact between the wire 25 and member 210 which might hinder correct coil formation.

A general advantage of the inclined plane or inclined cone which rotates relative to the mandrel compared with other known means for coil feeding such as ramps which are fixed relative to the mandrel, is the comparative insensitivity of successful coil feeding to such factors as tension of wire 25, friction, details of geometry and increased forces due to inertia required to push the coils off at increased machine speeds.

Typically, the cross-section of that part of the mandrel where filament winding takes place and filament turns are removed is acircular according to the required shape of the turns in the ribbon. Reference is made in the latter respect to U.K. Pat. Nos. 271,122 and 314,843. However, it is advantageous, as taught herein, for the latter-mentioned part of the mandrel to have also a cross-section which reduces in the direction in which the filament turns are removed.

From the foregoing description, it can be seen that there are many variations in geometry and construction for this type of winding machine, in which the winding means consists of a single element. Any of the features discussed herein can be used in suitable combination as dictated by the needs and circumstances, all having different advantages and disadvantages.

What is claimed is:

1. A winding machine for winding a filament on a mandrel, the winding machine comprising means for feeding the filament substantially along an axis of rotation, a single winding element which is rotatable about said axis of rotation, said winding element having one or more guide means for entraining the filament in a radial loop, said loop extending substantially from said axis of rotation to said guide means on one side of said axis only and rotating about said axis when said winding element is rotated; means for removing turns of the filament from the mandrel; restraining means to prevent rotation of said mandrel, and means for supplying a binding or positioning element longitudinally of the mandrel, the binding or positioning element being provided for binding or positioning turns of the filament which are wound on and subsequently removed from the mandrel, said means for supplying the binding or positioning element being located on an extension of the mandrel outside the zone of rotation of said winding element but within the zone of rotation of said radial loop.

2. A winding machine according to claim 1 including restraining means to prevent rotation of the mandrel, said restraining means comprising a first bevel gear fast with a fixed frame member, a second bevel gear fast with the mandrel extension, and drive means interconnecting said first and second bevel gears and rotatable about said axis when the winding element is rotated whereby said mandrel is effectively restrained from rotating.

3. A winding machine according to claim 1 including magnetic means for restraining rotation of the mandrel, said magnetic means causing a magnetic field to act across a gap through which said filament passes during rotation of the winding element, said field giving rise to a restraining force.

4. A winding machine according to claim 3 wherein said magnetic means comprises at least one pair of electromagnetic poles.

5. A winding machine according to claim 4 wherein said pair of electromagnetic poles are provided on one side of said gap and an armature is provided on the other side of said gap.

6. A winding machine according to claim 1 including restraining means to prevent rotation of the mandrel, said restraining means comprising a fixed frame member, detent means mounted on said fixed frame member, engagement means for said detent means, said engagement means being fast with the mandrel, and means for synchronising operation of said detent means with said winding means to provide unhindered passage for said filament when the winding means is rotated.

7. A winding machine according to claim 6 wherein said detent means are rotated by said synchronising means.

8. A winding machine according to claim 7 wherein two of said detent means are fast with a shaft, said shaft being rotated by said synchronising means.

9. A winding machine according to claim 8 wherein said detent means have two engagement cycles per rotation of said shaft.

10. A winding machine according to claim 1 including guide means for guiding said filament in a substantially straight line between said filament feeding means and said single winding element.

11. A winding machine according to claim 1 wherein said winding element comprises a body having a hub portion and at least one radial extending portion nearest said means for removing turns of the filament from the mandrel, and including a fixed frame member having bearings in which said hub portion is mounted.

12. A winding machine according to claim 11 wherein said hub portion contains bearings in which the mandrel is rotatably supported, the mandrel extension projecting axially of said axis of rotation towards said filament feeding means.

13. A winding machine according to claim 12 wherein said extension supports means over which said filament is guided.

14. A winding machine according to claim 1 wherein said means for removing turns of the filament from the mandrel comprises a member defining an inclined plane, said plane being relieved by a conical surface whose axis intersects with but is at an angle to the axis of rotation of the winding element.

15. A winding machine according to claim 1 wherein said winding element includes guide means for guiding the filament close to said axis of rotation, and a radially directed portion for guiding a loop of the filament which extends away from and towards said axis of rotation.

16. A winding machine according to claim 15 wherein said winding element comprises an axial extension, said axial extension surrounding and being concentric with the mandrel extension; the winding element extension containing bearings in which said mandrel extension is rotatably supported.

17. A winding machine according to claim 1 wherein the mandrel includes a part for forming said filament turns, said part having an acircular cross-section, said section reducing in the direction in which the filament turns are removed from the mandrel.

18. A winding machine for winding a filament on a mandrel, the winding machine comprising a single winding element having an axis of rotation, non-rotatable means for feeding the filament at least in part substantially along said axis of rotation to said single winding element, said winding element being provided as a unit separate from said filament feeding means, said winding element having guide means for entraining the filament in a radial loop, which loop extends substantially from said axis of rotation to said guide means on one side of said axis only and rotates about said axis with rotation of said winding element; means for removing turns of the filament from the mandrel; restraining means to prevent rotation of the mandrel; and means for supplying a binding or positioning element longitudinally of the mandrel, the binding or positioning element being provided for binding or positioning the turns of said filament wound on and subsequently removed from the mandrel, said means for supplying the binding or positioning element being located on an extension of the mandrel outside the zone of rotation of said winding element but within the zone of rotation of said radial loop.

19. The winding machine as defined in claim 1 wherein said removing means removes the filament turns from said mandrel in generally radially spaced loose relationship to said binding or positioning element in the substantial absence of a change in filament turn diameter and disposition.

20. The winding machine as defined in claim 18 wherein said removing means removes the filament turns from said mandrel in generally radially spaced loose relationship to said binding or positioning element in the substantial absence of a change in filament turn diameter and disposition.

* * * * *